US005161702A

United States Patent [19]

Skalski

[11] Patent Number: 5,161,702

[45] Date of Patent: Nov. 10, 1992

[54] DISPLAY DEVICE

[75] Inventor: John S. Skalski, Schaumburg, Ill.

[73] Assignee: Thomas A. Schutz Company, Morton Grove, Ill.

[21] Appl. No.: 694,568

[22] Filed: May 2, 1991

Related U.S. Application Data

[63] Continuation-in-part of Ser. No. 436,311, Nov. 14, 1989, Pat. No. 5,027,957.

[51] Int. Cl.[5] ..... A47F 7/00

[52] U.S. Cl. ..... 211/59.3; 211/43; 211/51

[58] Field of Search ..... 211/59.3, 59.2, 43, 211/51, 184

[56] References Cited

U.S. PATENT DOCUMENTS

| | | | |
|---|---|---|---|
| 2,145,563 | 1/1939 | Watson | 312/71 |
| 3,166,195 | 1/1965 | Taber | 211/49 |
| 3,308,961 | 3/1967 | Chesley | 211/49 |
| 4,729,481 | 3/1988 | Hawkinson et al. | 211/59.3 |
| 4,830,201 | 5/1989 | Breslow | 211/184 |

*Primary Examiner*—David M. Purol
*Assistant Examiner*—Sarah Lechok
*Attorney, Agent, or Firm*—Wood, Phillips, VanSanten, Hoffman & Ertel

[57] ABSTRACT

A display device having a front cartridge section against which objects can be stacked, one against the other, in a first line; first and second strips each wound about itself to define first and second coils with first and second axes; structure for connecting the strips to the front cartridge section so that the axes of the coils are transverse to the first line; and a rear cartridge section having first and second legs which are extendable at least partially through the first and second coils. By moving the rear cartridge section away from the front cartridge section in the first line with the first and second legs extended into the first and second coils, the legs cause the first and second coils to unwind, whereby a force is developed on the first and second strips tending to draw the front and rear cartridge sections towards each other so that an article to be displayed can be resiliently captured in a display position between the front and rear cartridge sections.

23 Claims, 4 Drawing Sheets

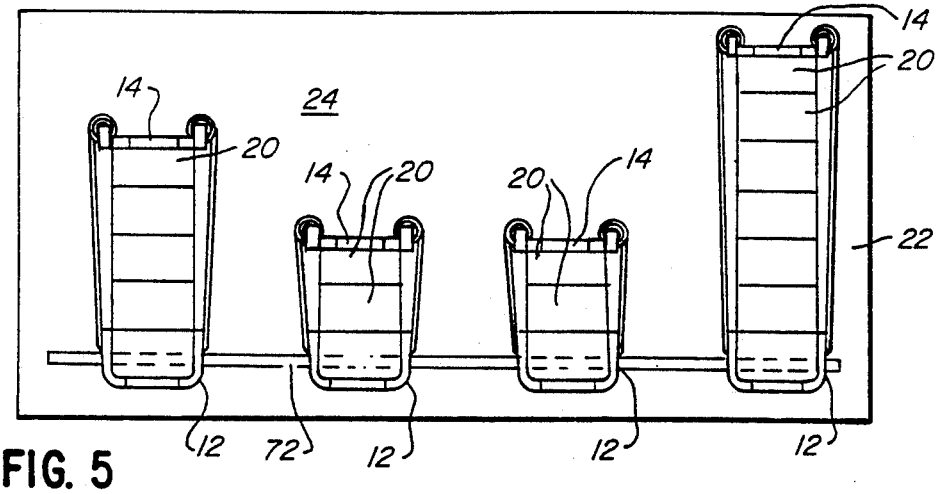
FIG. 5
FIG. 7
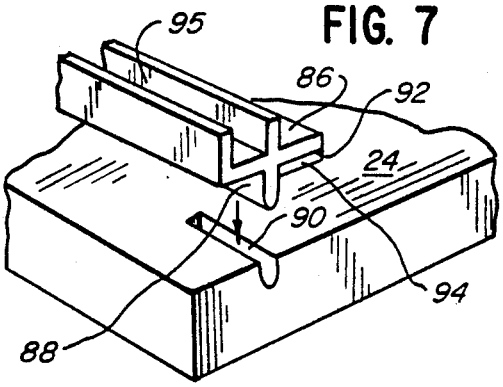
FIG. 6
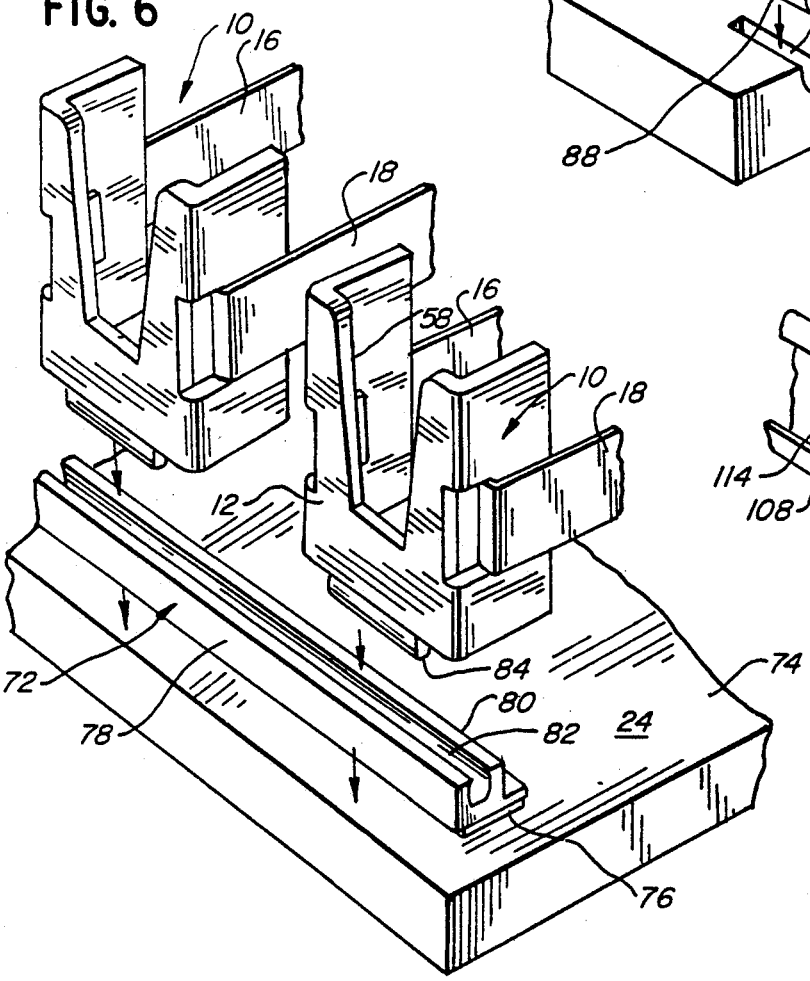
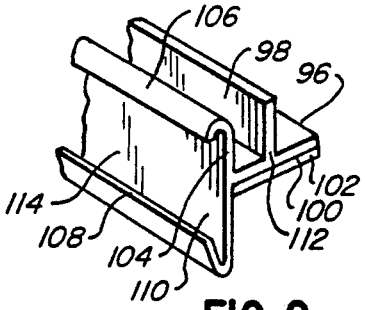
FIG. 8

DISPLAY DEVICE

CROSS-REFERENCE TO RELATED APPLICATION

This application is a continuation-in-part of U.S. Ser. No. 436,311, now U.S. Pat. No. 5,027,957 filed Nov. 14, 1989.

BACKGROUND OF THE INVENTION

1. Field of the Invention

This invention relates to article display devices and, more particularly, to a device into which articles are loaded and normally urged into a display position.

2. Background Art

It is common to display merchandise in retail establishments in devices having elongate rails and pushers guided on the rails and biased so as to urge articles into a display position. One exemplary structure is shown in U.S. Pat. No. 3,308,961, to Chesley. A pusher plate 28 is guided in fore and aft movement on spaced rails 32 fixedly secured to a support shelf. A coil spring 34 biases the pusher plate 28 towards the front of the device so that articles engaged thereby are biased into a display position.

While devices such as that shown in Chesley have proven effective for their intended purpose, they have numerous drawbacks. First, Chesley discloses an intricate arrangement of numerous elements. Resultingly, the costs attendant the manufacture of such a device are relatively high.

Further, the Chesley components must be manufactured and assembled to close tolerances to be operable. A flaw in one of the rails 20, which are inherently prone to being bent in use, can render the entire device inoperable.

A further drawback with the Chesley device is that it must be custom built to match individual shelf configurations. It is therefore impossible to make a universal design for different retail establishments. On site assembly by skilled personnel may be required.

If one attempts to make a standard structure, the structure would be made to accommodate the largest anticipated number of articles. If only a few articles are in the display, a large unsightly structure remains in place, which makes the remainder of the shelf unusable.

A still further drawback with a structure, such as that in Chesley, is that once in place, the device lacks versatility. That is, it is designed for a specific width article and a specific arrangement of articles along the width of the shelf. Should one desire to change shelf locations for specific articles, one would have to disassemble and reconstruct or replace the device on a different shelf. The inconvenience to a store operator is apparent.

The device such as that in Chesley is also inconvenient from a manufacturer's standpoint. Many different parts must be made and inventoried. The rails are long and thus take up a considerable amount of space. Because of the intricate interconnection of parts, variation in one dimension of the Chesley device, as required by one user, may require a redesign of the entire structure, which may not be feasible given the price ceilings contended with by manufacturers.

SUMMARY OF THE INVENTION

The present invention is specifically directed to overcoming the above-enumerated problems in a novel and simple manner.

According to the invention, a display device is provided and has a front cartridge section against which objects can be stacked, one against the other, in a first line; first and second strips each wound about itself to define first and second coils with first and second axes; structure for connecting the strips to the front cartridge section so that the axes of the coils are transverse to the first line; and a rear cartridge section having first and second legs which are extendable at least partially through the first and second coils. By moving the rear cartridge section away from the front cartridge section in the first line, with the first and second legs extended into the first and second coils, the legs cause the first and second coils to unwind, whereby a force is developed by the first and second strips tending to draw the front and rear cartridge sections towards each other so that an article to be displayed can be resiliently captured in a display position between the front and rear cartridge sections.

The present invention has as its principal objectives the provision of a simple, inexpensive display device which is extremely versatile. At the same time, the device has a very compact configuration.

The device can be configured so that, with no articles being displayed, the rear cartridge section is drawn closely against the front cartridge section by the strips. The compact configuration facilitates shipping and handling and minimizes inventory space requirements.

At the same time, the device is extremely simple by reason of its obviating the need for conventional guide structure, such as rails. The front cartridge section can be suitably secured to a shelf, at any desired location. The amount of space taken up by the overall device is dictated by the size and number of articles. With no articles in place, the rear cartridge section and strips retract into a very compact configuration. As the articles are loaded in place, one against the other, in a fore and aft direction, the biasing strips cause an even pressure to be applied by the back wall against the articles so that they are firmly captured in aligned relationship between the front and rear cartridge sections.

By simply varying the strip length, the capacity of the display device can be altered, as desired.

The invention also contemplates structure for attaching the front cartridge section both fixedly to a shelf and releasably to be selectively attached at any of a number of desired locations on the shelf.

The front cartridge section can be directly fixedly attached to a shelf through the use of screws, adhesives, etc. Alternatively, and in a preferred form, a rail is provided and suitably secured to the shelf on which articles are to be displayed. In one form, an elongate rail is provided with a lengthwise slot. The front cartridge section has a rib/projection which is received in the slot so that the projection is slidable lengthwise of the rail. The projection maintains the front cartridge section against fore and aft movement. With suitable rails on different shelves, the store owner can simply place the display device in a desired location on any shelf.

It is also possible to have a projection/slot integrally formed with the shelf and a cooperating rail/slot on the display device. By separating the device(s) from the rails, the shelf is freed to be useable for other purposes.

In one form of the invention, a clip is formed integrally with the rail, which clip is capable of carrying a price and/or descriptive information relating to the article.

To simplify manufacture of the device, preferably the rail is formed by an extrusion process. The front and rear cartridge sections are molded from plastic. The strips can be metal, MYLAR®, such as the coils described in U.S. Pat. No. 3,426,115, or other suitable material capable of maintaining a coiled configuration. Assembly of the device involves merely securing the strip ends to the front cartridge section and projecting the legs on the rear cartridge section through the coils.

In its simplest form, the rear cartridge wall can be a U-shaped member, such as a formed wire. The U-shaped wire is directed through the coils, preferably in an inverted orientation.

Another aspect of the invention is the provision of structure on the rear cartridge wall extending upwardly beyond the anticipated height of objects to be displayed so that the location of the rearwardmost article displayed by the device can be readily identified, thereby facilitating inventorying by the store owner.

Preferably, the front and rear cartridge sections are molded from plastic.

In an alternative embodiment of the present invention, an article support includes first and second facing wall surfaces having a height defining a space therebetween for articles to be placed for movement thereof between a first storage position and a second access position. A first strip is wound about itself to define a first coil with a first axis. A connector connects the first strip to the article support so that the first strip can be stretched to place the first coil in a partially uncoiled state. A second strip is wound about itself to define a second coil with a second axis. A connector connects the second strip to the article support so that the second strip can be stretched to place the second coil in a partially uncoiled state. The first and second coils of the first and second strips urge articles in the first storage position towards the second access position as the first and second strips recoil. There is no structure required for connecting between the first and second coil so that the first and second coils recoil independently from their partially uncoiled state. The first and second coils in their partially uncoiled state each have a sufficient diameter to prevent passage of the articles therebetween.

In a preferred alternative embodiment, the first and second axes are substantially parallel and the articles translate in a first line between the first and second positions therefor.

In still another alternative embodiment, the first and second facing wall surfaces are connected to a bottom surface upon which the articles are supported in a vertical direction. The first facing wall surface includes a forwardly facing edge. A retainer holds at least one article in said access position and the first and second coils urge an article in the storage position against the one article.

In still a further alternative embodiment, the retainer is a wall attached to the bottom surface transverse to the first and second facing wall surfaces. The wall of the first retainer has a cutout and/or has a sufficiently low profile to permit viewing of the article in the access position.

In still another alternative embodiment, the first strip includes first and second ends. The first coil is located at the first end while the connector on the first strip connects the second strip end to the article support.

In another alternative embodiment, the first strip includes a first bend located between its first and second ends. The first bend wraps around the forwardly facing edge of the first facing wall surface. The first strip preferably has a notch at the first bend and the forwardly facing edge has a pin extending into the notch to prevent vertical movement and lengthwise slippage of the first strip.

BRIEF DESCRIPTION OF THE DRAWINGS

FIG. 5 is a schematic plan view of a plurality of the inventive display devices on a shelf;

FIG. 6 is a perspective view of a shelf section showing a mounting element/rail thereon for a plurality of display devices;

FIG. 7 is a perspective view of a section of a shelf with a groove therein for reception of a mounting element for the display device;

FIG. 8 is a perspective view of a section of a modified form of mounting element/rail according to the invention;

DETAILED DESCRIPTION OF THE PREFERRED EMBODIMENT

Figure 1:
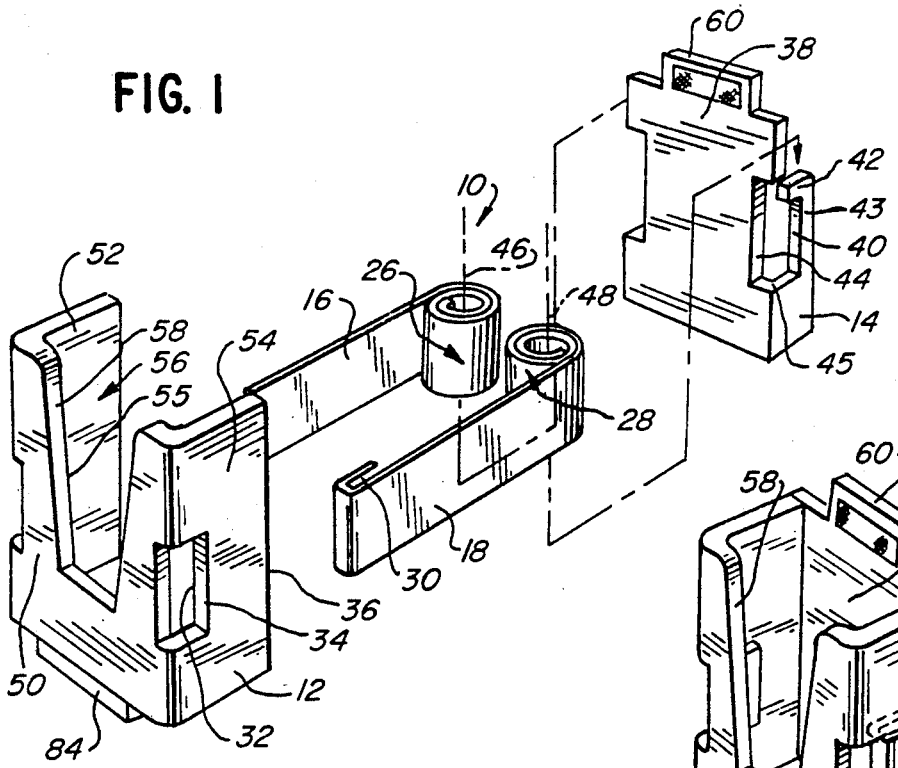
FIG. 1 is an exploded perspective view of a display device, according to the present invention.
Figure 2:
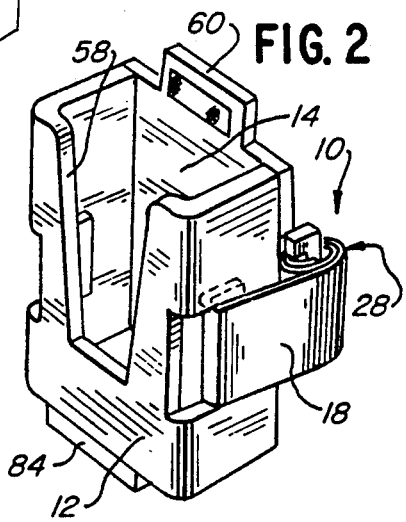
FIG. 2 is a perspective view of the device in FIG. 1 in its assembled state without any articles displayed therein.

One form of display device, according to the present invention, is shown at 10 in FIGS. 1 and 2. The display device/cartridge 10 consists of a front cartridge section 12, a rear cartridge section 14, and first and second flexible strips 16, 18, respectively, for interconnecting the front and rear cartridge sections 12, 14.

The above elements cooperate to releasably embrace a plurality of articles 20 to be displayed, as depicted schematically in FIG. 5. The articles 20 may take any shape and size. The articles 20 are shown in squared containers, such as cigarette packs, and the like. It should be understood that the identify of the article 20 is irrelevant to the invention.

The invention contemplates that the front cartridge section 12 be attached to the upwardly facing surface 22 of a shelf 24. The articles 20 are loaded between the front cartridge section 12 and rear cartridge section 14 and are biased towards the front cartridge section 12 by the strips 16, 18 into a display position, wherein they are readily seen and removable by a consumer.

To accomplish the above, the strips 16, 18 are wrapped about themselves to define coils 26, 28, respectively. The strips 16, 18 may be formed of conventional spring-type metal, or by other material, such as MYLAR®. In U.S. Pat. 3,426,115, a suitable method is disclosed for forming MYLAR®, coils, that can be used according to the present invention. The strips can have a width as shown in FIGS. 1–4, or may be wider such as the corresponding strips 16, 18 shown in FIG. 6.

Connection of each strip 16, 18 to the cartridge sections 12, 14 is the same, and thus description herein will be limited to exemplary strip 18. The strip 18 has a forward end 30, which is connected to the front cartridge section 12. A cutout 32 is provided in the front cartridge section to define a forwardly facing edge 34. The free end 30 of the strip 18 is wrapped around the edge 34 and suitable secured to the front cartridge section 12 thereadjacent, as by an adhesive. With the strip end 30 connected to the section 12, as shown, the coil 28 resides closely adjacent to the rear edge 36, as seen in FIG. 2.

The rear cartridge section 14 has a forwardly facing surface 38 for abutment with the edge 36 of the wall 12. The wall 14 has upwardly projecting legs 40 (one shown) spaced slightly rearwardly of the wall surface 38. With the strips 16, 18 secured to the front cartridge section 12, the rear cartridge section 14 can be assembled by directing the leg 40 upwardly through the coil 28. The leg 40 has sufficient height that it projects fully through the coil 28. A transverse blocking member 42 is provided on the free end 43 of the leg 40 to prevent escape of the coil 28 from the leg 40 in use. The rear cartridge section 14 has a cutout 44 to accommodate the coil 28 with the coil 28 surrounding the leg 40. The cutout defines a ledge 45 for supporting the coil 28. The opposite leg (not shown) on the rear cartridge section 14 extends through the coil 26 in like manner. Preferably, the legs 40 on the rear cartridge section 14 are substantially parallel, as are the axes 46, 48 of the coils 26, 28, respectively, through which the legs 40 extend.

With the device 10 assembled, the strips 16, 18 tend towards their wrapped configuration and in so doing draw the rear cartridge section 14 against the front cartridge section 12, as shown in FIG. 2. As articles are loaded between the cartridge sections 12, 14, the strips 16, 18 are caused to unwind, while maintaining a bias tending to draw the cartridge sections 12, 14 towards each other. The force developed by the strips 16, 18 is the same so that the articles 20 remain positively in line, one behind the other, as seen in FIG. 5. As is apparent from FIGS. 1, 2 and 5, the device 10 is very compact and takes up an amount of space directly proportional to the number of articles 20 loaded therein. Preferably, the cartridge sections 12, 14 are molded from plastic. The front cartridge section 12 has a front wall 50 and spaced side walls 52, 54 projecting rearwardly from the front wall 50. The rearwardly facing surface 55 of the front wall 50 and the side walls 52, 54 cooperatively define a receptacle at 56 configured to match the shape of and be slightly larger than one of the articles 20 to be displayed by the device 10. The rear cartridge section 14, under the force exerted by the strips 14, 18, urges an article 20 into the receptacle 56 and a display position for that article 20. A cutout 58 is provided in the front wall 50 to permit viewing of the article 20 in the display position and grasping by a purchaser for removal.

The rear cartridge section 14 has a tab 60 projecting upwardly beyond the maximum anticipated height of the articles 20, so as to give a visual indication of the rearwardmost article 20. This conveniently and positively alerts the store owner as to the number of articles 20 in the device 10.

Figure 3:
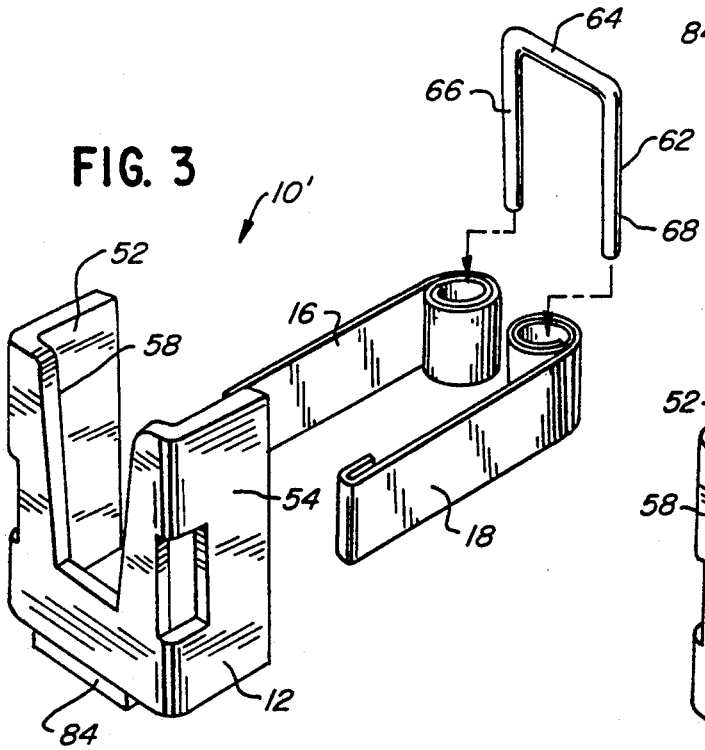
FIG. 3 is a perspective view of a modified form of display device, according to the present invention.
Figure 4:
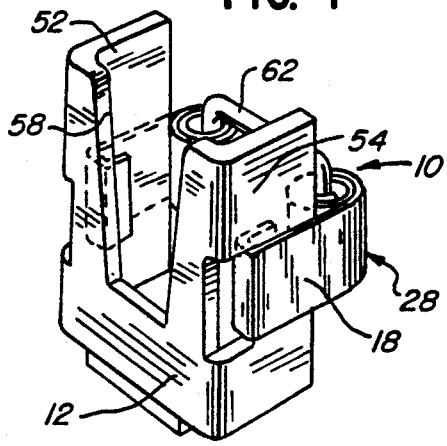
FIG. 4 is a perspective view of the device in FIG. 3 in its assembled state without any articles displayed therein.

A simplified form of the device 10 is shown at 10' in FIGS. 3 and 4. The only difference between the device 10' in FIGS. 3 and 4 and that 10 in FIGS. 1 and 2 is that the rear cartridge section 62 in the former is modified from that 14 in FIGS. 1 and 2. The cartridge section 62 is a simple U-shaped element with a cross bar 64 and depending legs 66, 68. The legs 66, 68 are directed downwardly through the coils 26, 28, respectively, and are drawn by the coils as the strips 16, 18 tend to rewind themselves. The rear cartridge section 62 can be simply formed by a piece of heavy gauge wire or alternatively formed as a molded piece of plastic.

The invention also contemplates structure for holding the device 10 fixedly against fore and aft movement on a shelf 24. The structure for doing this is shown in FIGS. 5–8. An elongate mounting element/rail 70, preferably formed by an extrusion process, is mounted to the upwardly facing surface 74 of the shelf 24. The rail 72 can be held in place by a two-sided adhesive strip 76, or by other suitable means, such as screws, etc. The rail has spaced walls 78, 80 defining therebetween an upwardly opening, U-shaped groove 82.

The front cartridge section 12 has a depending rib/projection 84, which is accepted by the groove 82. The projection has a cross section generally matched to that of the groove 82 and is dimensioned to be snugly, but releasably accepted within the rail groove 82. To assemble the device 10 on the shelf 24, one need only press the rib/projection 84 into the groove 82 at the desired location along the shelf width. The articles 20 can then be simply loaded between the front and rear cartridge sections 12, 14, respectively. The device 10 needs no additional guide structure and takes up only that amount of space on the shelf 24 as is needed by the number of articles being displayed. If the display device 10 is no longer needed, it is simply drawn upwardly off of the rail 70 so that the shelf 24 is free to be used as desired.

Modified forms of the rail 12 are shown in FIGS. 7 and 8. In FIG. 7, a rail 86 is shown with a rib 88 projecting downwardly therefrom for reception in a groove 90, defined directly in the shelf 24. The rail 86 has a downwardly facing surface 92 for bearing against the upwardly facing surface 74 of the shelf 24. An adhesive layer 94 is interposed between the surfaces 92, 74 to prevent lateral shifting of the rail 86 relative to the shelf 24 and separation of the rib 88 from the groove 90. The rail 86 has a corresponding, upwardly opening groove 94 for acceptance of the ribs 84 on the devices 10. It should be understood that the rib 84 can be configured to cooperate directly with the groove 90 in the shelf 24. This obviates the need for a separate rail 86.

A further modified form of rail 96 is shown in FIG. 8. The rail 96 has an upwardly opening groove 98 for the ribs 84 and a downwardly facing surface 100 attached to the upwardly facing shelf surface 74, as by an adhesive strip 102. The principal difference between the rail 96 and that 86 in FIG. 7 is that the forward wall 104 bounding the groove 98 has a downwardly turned upper end 106 and an upwardly turned bottom end 108, defined on the portion 110 of the wall 104 extending downwardly below the main body 112 of the rail 96. The forwardly facing surface 114 of the wall 104 can accommodate pricing information, etc. relating to the articles 20 in the device 10. The turned ends 106, 108 cooperate to capture paper strips, or the like, placed against the surface 114.

Figure 9:
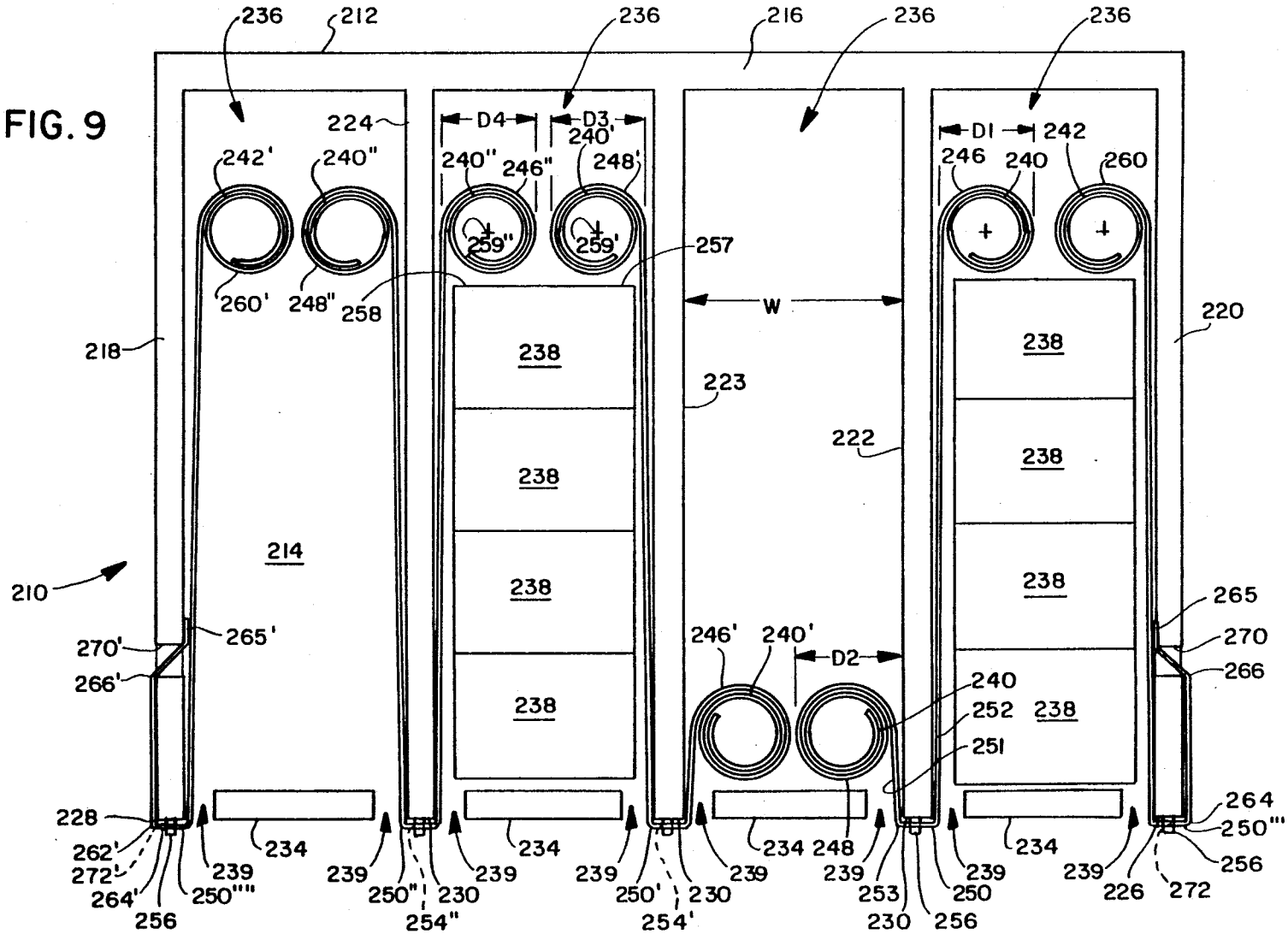
FIG. 9 is a schematic plan view of an alternative embodiment of the inventive display device.
Figure 11:
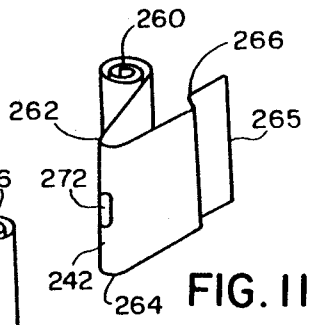
FIG. 11 is a perspective view of one of the flexible strips shown in FIG. 10.
Figure 12:
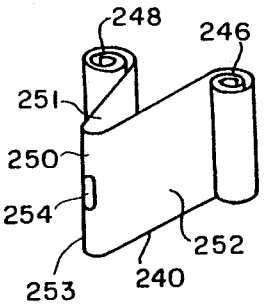
FIG. 12 is a perspective view of another of the flexible strips shown in FIG. 10.
Figure 10:
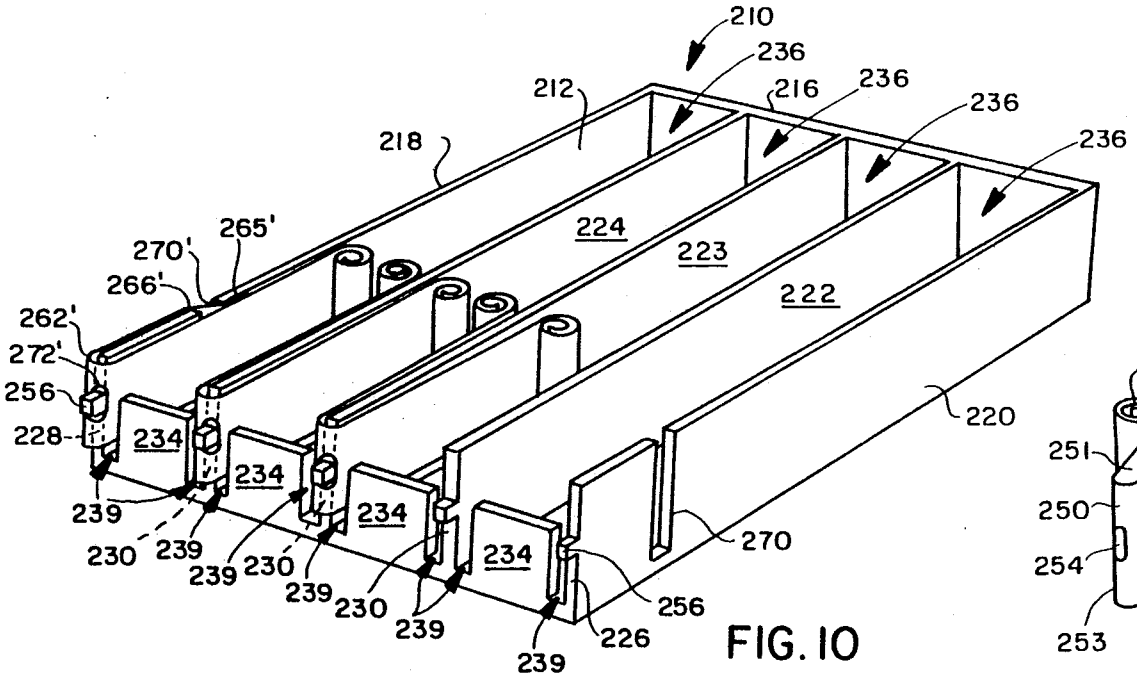
FIG. 10 is a perspective view of the device in FIG. 9 in its assembled state without any articles displayed therein and with article engaging coiled strips thereon partially uncoiled to facilitate loading of articles into the device.
Figure 13:
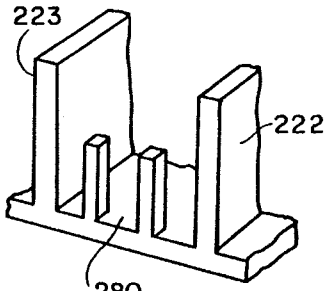
FIG. 13 is a perspective view of a modified form of a retaining wall at the front of the device and against which displayed articles are borne by the strips.

An alternative form of display device, according to the present invention, is shown at 210 in FIGS. 9 and 10. The display device/cartridge 210 consists of an article carrying tray 212 having a bottom surface 214, a rear wall 216, side walls 218, 220, and center partition walls 222, 223, 224. The side walls 218, 220 have forwardly facing front edges 226, 228, respectively. The center walls 222, 223, 224 have corresponding front, forwardly facing edges 230.

Side walls 218, 220, rear wall 216, center partition walls 222, 223, 224 and front retaining walls 234 define rectangular receptacles 236 for supporting a plurality of articles 238 for display. The articles 238 shown are, for example, cigarette packs, or the like.

Gaps 239 are formed between the retaining walls 234 and the forwardly facing front edges 226, 228, 230 of each of the walls 216, 218, 220, 222, 223, 224.

The invention contemplates that a plurality of articles 238 be placed in the receptacles 236 and urged forwardly against the retaining walls 234 where they are readily seen and removable by a customer.

To accomplish the above, flexible strips 240, 240', 240'', 242, 242' are provided in pairs, in each of the receptacles 236. The flexible strip 240 is wrapped about itself in a first direction at one end to define a coil 246 with a first diameter D1. The opposite end of the flexible strip 240 is wrapped about itself in an opposite direction to define a second coil 248 having a diameter D2. The flexible strip 240 is pre-bent at 250, approximately mid-way between coils 246 and 248. The strip 240 wraps around and conforms to the front edge 230 of the wall 222 so that side walls 251, 252 of the strip 240 extend from an apex 253 of the bend 250 and are substantially parallel. A slight angle may be defined between the walls 251, 252 if a lateral pressure against the articles 238 is desired.

The strip 240 has a notch 254 therethrough at the bend 250. The center walls 222, 223, 224 have a pin 256 projecting forwardly at the front edges 230 thereof for direction into the notch 254, 254', 254'', respectively, in the strip 240. The front edges 226 of the side walls 218, 220 each have a like pin 256. Each of the other strips 240', 240'', 242, 242' has a bend 250', 250'', 250''', 250'''' respectively for accommodating walls 223, 224, 222, 220, 218, respectively.

The coil 246 and coil 248 of the flexible strip 240 are located in adjacent receptacles 236. The gaps 239 permit the strip walls 251, 252 to extend from the bend 250 rearwardly past the walls 234. The notch 254 and pin 256 arrangement prevents the flexible strip from moving in a vertical direction and from shifting horizontally relative to the wall 222. FIG. 9 shows coils 246', 248 fully coiled and bearing against the retaining wall 234. Preferably, the coils 246', 248 have sufficient restoring force to bear the bends 250, 251' against the front edge 230 to thereby keep the notches 254, 254' and pins 256 engaged when a receptacle 236 does not hold any articles 238. While a notch 254 and pin 256 arrangement is disclosed, adhesive or other fastening means are also contemplated to maintain the strips 240, 240', 240'', 242, 242' in place. For example, adhesive may be used in the event that the flexible strips 240, 240', 240'', 242, 242' do not have sufficient restoring force when articles 238 are not present.

The distance W (FIG. 9) between any two walls 218, 220, 222, 223, 224 of the tray 212 adjacent the retaining wall 234 should be wide enough to accommodate the diameters of the two coils therein when no articles 238 are present and the strips are fully recoiled ($W > (2 \times D2)$). The distance W between adjacent side walls can be reduced gradually towards the rear wall 216 due to the decrease in the diameter of the coils as they are uncoiled.

The receptacle 236' and the coils 248', 246'' of the strips 240', 240'', respectively, will be used to explain the operation of flexible strips 240. As articles are loaded into the receptacle 236', the coils 248', 246'' of the strips 240', 240'', respectively, are caused to unwind. The notches 254', 254'' prevent the strips 240', 240'' from moving vertically or horizontally. Since the strips 240', 240'' are preferably made of the same material, the force developed by each strip 240', 240'' is the same when unwound the same distance from the retaining wall 234.

The diameters D3 and D4 of the flexible strips 240', 240'' when fully unwound to the back wall 216 should be wide enough to positively engage edges 257, 258 of the article 238. Thus, the minimum width of the diameters depends on the relationship between the width W of the receptacle and the distance between edges 257 and 258. The two coils 248', 246'' of the flexible strips 240', 240'' tend towards their wrapped configuration and in so doing, the diameters D3, D4 bias the edges 257, 258 of the rearmost article 238 forwardly against the other articles 238.

The forwardmost article 238 is held captively in the display position against the retaining wall 234. When the forwardmost article is removed, the articles 238 are again urged forwardly by the coils 248', 246'' until another article 238 is held captively against the retaining wall 234. It is important to note that the coils 248', 246'' lack any structure (for example, cross bar 64 in FIG. 3) between axis 259', 259'', respectively. Further, the coil 246' can be fully recoiled (no articles) while the coil 248' is fully unwound (articles) because of the notches 254', 254''.

Flexible strip 242 is wrapped about itself at one end to define a coil 260, 260'. Flexible strip 242' has an orientation opposite flexible strip 242 as best seen in FIG. 9. A middle 262, 262' of flexible strip 242, 242' includes a forward bend 264, 264'. The forward bend 264, 264' is preferably approximately 360°,however, forward bend 264, 264' may have a bend of less than 360° if a lateral pressure on the articles 238 is desired. The forward bend 264, 264' is made with the coil 260, 260' rolled in an outwardly facing direction. At an end 265, 265' opposite the coil 260, 260', an interlocking bend 266, 266' is formed in the flexible strip 242, 242'. Side walls 218, 220 include a slot 270', 270, respectively, adjacent the front facing edges 228, 226, respectively, and a pin 256 located on the front facing edges 228, 226.

The distance between the front facing edge 226, 228 and the slot 270, 270' is approximately equal to the distance between the forward bend 264, 264' and the bend 266, 266' such that when the forward bend 264, 264' of flexible strip 242 is placed over the front facing edge 226, 228 of the side walls 220, 218, respectively, and into the gap 239, the bend 266, 266' interlocks with the slot 270, 270' fastening the flexible strip 242, 242' to the display cartridge 210. The notch 272, 272' locks with the pin 256 to prevent horizontal or lateral movement. Coil 260, 260' is then located in receptacle 236 as flexible strips 242, 242' are mounted on the forward facing edges 226, 228 of side walls 220, 218 and interlocking bends 266, 266' are engaged with slots 270, 270'.

While slots 270, 270' and interlocking bends 266, 266' are disclosed, alternative fastening means are contemplated. The ends 265, 265' of the flexible strips 242, 242' opposite the coil 260, 260' may be fastened to side wall 220, 218 by adhesive or other fastening means.

The flexible strips 242, 240 urge articles 238 forwardly similar to flexible strips 240', 240'' except that the interlocking bend 266 located at the end 265 of the strip 242 is engaged in slot 270 rather than being an additional coil engaging article in an adjacent slot as described above with respect to strips 240, 240', 240''.

The flexible strips 240, 240', 240'', 242, 242' may be formed of conventional spring-type metal, or by other material, such as Mylar ®. In U.S. Pat. No. 3,426,115, a suitable method is disclosed for forming Mylar ® coils, that can be used according to the present invention.

The invention also contemplates that a cut-out 280 may be made in retaining wall 234 to permit viewing of the article 238. Alternatively, retaining wall 234 may be made of a transparent material, such as clear plastic.

Figure 14:
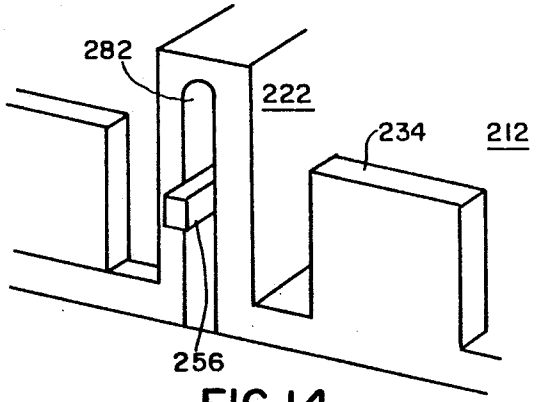
FIG. 14 is a perspective view of a still further modified form of device according to the present invention the formation of which can be accomplished by vacuum molding.

The tray 212 may be injection molded, vacuum formed or fabricated. FIG. 14 shows tray 212 made by vacuum forming. As a result of vacuum forming, center wall 222 would include a hollow portion 282. In this case, pin 256 may be separately formed and placed into hollow portion 282.

The foregoing disclosure of specific embodiments is intended to be illustrative of the broad concepts comprehended by the invention.

What is claimed is:

1. A display dispenser for articles, said display dispenser comprising:

an article support having first and second facing wall surfaces having a height defining a space therebetween for articles to be placed for movement thereof between a first storage position and a second access position;

a first strip wound about itself to define a first coil with a first axis;

means for connecting the first strip to the article support so that the first strip can be stretched to place the first coil in a partially uncoiled state;

a second strip wound about itself to define a second coil with a second axis; and means for connecting the second strip to the article support so that the second strip can be stretched to place the second coil in a partially uncoiled state, the first and second coils of the first and second stretched strips urging articles in the first storage position towards the second access position as the first and second strips recoil, there being no structure connecting between the first and second coils so that the first and second coils recoil independently from their partially uncoiled state, said first and second coils, in their partially uncoiled state, each having a sufficient diameter to prevent passage of articles therebetween.

2. The article display dispenser according to claim 1 wherein the first and second axes are substantially parallel.

3. The article display dispenser according to claim 2 wherein articles translate in a first line between the first and second positions therefor.

4. The display dispenser of claim 1 wherein the first and second facing wall surfaces are connected to a bottom surface upon which the articles are supported in a vertical direction.

5. The display dispenser of claim 4 wherein the first facing wall surface includes a forwardly facing edge against which at least one of the first and second strips bears.

6. The display dispenser of claim 5 further including a retaining means for holding at least one article in said access position and wherein the first and second coils urge the article in the storage position against said at least one article.

7. The display dispenser of claim 6 wherein the retaining means is a wall attached to the bottom surface transverse to the first and second facing wall surfaces.

8. The display dispenser of claim 7 wherein the wall of the first retaining means includes a cutout to permit viewing of said at least one article in said access position.

9. The display device of claim 7 wherein the wall of the retaining means is formed of clear plastic to permit viewing of a said at least on article in said access position.

10. The display device of claim 5 wherein the first strip includes a first end, the first coil is located at the first end, while said first means for connecting said first strip to said article support is located at a second end opposite said first end.

11. The display device of claim 10 wherein said first strip includes a first bend located between said first and second end, the first bend engaging the forwardly facing edge.

12. The display device of claim 10 wherein the first wall surface includes a slot adjacent said forwardly facing edge and wherein the first connecting means includes a transverse bend at said second end which is received in said slot.

13. The display dispenser of claim 12 wherein the first strip includes a notch on the first bend engaging the forwardly facing edge and wherein the forwardly facing edge includes a pin engaging the notch to prevent vertical movement of the first strip.

14. A display dispenser for articles comprising:

a tray including first and second side walls each having a forwardly facing edge, and a bottom surface;

a first retainer against which the articles are to be stacked, one against the other, in a first line, the first retainer is attached to the bottom surface;

a first strip wound about itself at one end to define a first coil having a first variable diameter, the first strip including a first fastener located at an opposite end, and a first forward bend located between the first coil and the first fastener;

a second strip wound about itself at one end to define a second coil having a second variable diameter, the second strip including a second fastener located at an opposite end, and a second forward bend located between the second coil and the second fastener;

the first forward bend is engaged with the forward facing edge of the first side wall, the first coil is located between the first and second side walls and the first fastener is attached to the first side wall;

the second forward bend is engaged with the forward facing edge of the second side wall, the second coil is located between the first and second side walls and the second fastener is attached to the second wall;

there being no structure connecting between the first and second coils so that the first and second coils recoil independently from their partially uncoiled state;

whereby when articles are placed between the first retainer and the diameters of the first and second coils, a force is developed by the first and second strips tending to draw the diameters of the first and second coils towards the first retainer so that the article is resiliently captured in a display position between the first retainer and the diameters of the coils.

15. The display device according to claim 14 wherein the forward facing edges of the first and second side walls include a pin and both the first and second strips include a notch on the first and second forward bend, respectively, the pin and the notch for preventing at least one of vertical and horizontal movement of the first and second flexible strips relative to the article support.

16. The display device of claim 14 wherein the retainer includes a cutout to permit viewing of a forwardmost article being displayed.

17. The display device of claim 14 wherein the retainer is formed of clear plastic to permit viewing of a forwardmost article being displayed.

18. The display device according to claim 14 wherein at least one of the first and second flexible strips is made at least partially of plastic.

19. The display device according to claim 14 wherein at least one of the first and second flexible strips is made at least partially of metal.

20. The display device of claim 14 wherein the rectangular tray is made by vacuum forming.

21. The display device of claim 14 wherein the fastener of each first and second strip includes a transverse bend in the opposite end, and the first and second side walls include a slot located a distance from the forward facing edge, the transverse bend being located approximately the same distance from the first and second bends such that as the first and second forward bends are engaged with the forward facing edges of the first and second side walls, the transverse bend is aligned with the slot to lock the first and second strips in place.

22. A display dispenser for articles comprising:

an article support including first and second side walls each having a forward facing edge, at least one center wall having a forward edge and a bottom surface;

a first and second retainer against which the articles are to be stacked, one against the other, in a first and second line, the first and second retainers both being attached to the bottom surface;

a first strip wound about itself at one end to define a first coil having a first diameter, the first strip including a first fastener located at an opposite end, and a first forward bend located between the first coil and the first fastener;

a second strip wound about itself at one end to define a second coil having a second diameter, the second strip including a second fastener located at an opposite end, and a second forward bend located between the second strip and the second fastener; and at least one center strip wound about itself at one end in one direction to define a third coil having a variable diameter and wound about itself at the opposite end in an opposite direction to define a fourth coil having a variable diameter, the center strip including a third forward bend located between the third and fourth coils, the first forward bend is engaged with the forward facing edge of the first side wall, the first coil is located between the first side wall and the center wall and the first fastener is attached to the first side wall, the second forward bend is engaged with the forward facing edge of the second side wall, the second coil is located between the center wall and the second side wall and the second fastener is attached to the second wall, the third forward bend is engaged with the forward facing edge of the center wall, the third coil is located adjacent the first coil and the fourth coil is located adjacent the second coil, there being no structure connected between the first and second coils so that the first and second coils recoil independently from their partially uncoiled state, whereby when articles are placed between the first and second retainer and the diameters of the first and third and second and fourth coils, a force is developed by the first and second strips tending to draw the diameters of the first, second, third and fourth coils towards the first and second retainer so that the article is resiliently captured in a display position between the first and second retainer and the diameters of the coils.

23. The display device according to claim 22 wherein forward facing edges of the first and second side walls and the center wall each include a pin, and the first, second and center strips each include a notch on the first, second and third forward bend, respectively, for reception of a pin, the pin and the notch preventing vertical or horizontal movement of the first and second flexible strips relative to the article support.

* * * * *